US006536705B1

(12) United States Patent
Böck

(10) Patent No.: US 6,536,705 B1
(45) Date of Patent: Mar. 25, 2003

(54) PROCESS AND WINDING MACHINE FOR WINDING A MATERIAL WEB

(75) Inventor: Karl Josef Böck, Heidenheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 72 days.

(21) Appl. No.: 09/639,891

(22) Filed: Aug. 15, 2000

(30) Foreign Application Priority Data

Aug. 20, 1999 (DE) ..... 199 39 506

(51) Int. Cl.[7] ..... B65H 18/14
(52) U.S. Cl. ..... 242/541.4; 242/541.5
(58) Field of Search ..... 242/541.4, 541.5, 242/541.6, 542.3

(56) References Cited

U.S. PATENT DOCUMENTS

| | | | | |
|---|---|---|---|---|
| 4,390,139 | A | | 6/1983 | Alexander, III |
| 5,494,237 | A | | 2/1996 | Summey, III |
| 5,685,909 | A | | 11/1997 | Reich et al. |
| 6,311,922 | B1 | * | 11/2001 | Beisswanger et al. ... 242/542.3 |

FOREIGN PATENT DOCUMENTS

| | | | |
|---|---|---|---|
| DE | 282 | * | 7/1877 |
| DE | 3524748 | | 1/1987 |
| DE | 3620812 | | 12/1987 |
| DE | 29611112 | | 10/1996 |
| DE | 29721832 | | 3/1998 |
| DE | 19822261 | | 5/1998 |
| DE | 19805412 | | 8/1999 |
| EP | 0483092 | | 4/1992 |
| EP | 0855354 | | 7/1998 |
| WO | 95/30049 | | 11/1995 |

OTHER PUBLICATIONS

German Publication No. DIN ISO 8791–4.
An English Language abstract of WIPO 99/41174.

* cited by examiner

*Primary Examiner*—John Q. Nguyen
(74) *Attorney, Agent, or Firm*—Greenblum & Bernstein, P.L.C.

(57) ABSTRACT

Process and apparatus for winding a material web onto a reel spool to produce a wound reel. The process includes producing the material web, online smoothing of the produced material web, guiding the smoothed material web over a reel drum and through a nip formed between the reel drum and one of the reel spool and the wound reel, maintaining contact between the reel drum and the one of the reel spool and the wound reel, and reeling file smoothed material web while transversely moving at least one of the reel drum and the one of the reel spool and the wound reel relative to a web travel direction. The apparatus includes a web production facility, an online smoothing device, a reel drum, and a reel spool. A nip is formed between the reel drum and one of the reel spool and the wound reel, and the reel drum and the one of the reel spool and the wound roll are arranged to maintain contact during a winding procedure. At least one device is arranged to move at least one of the reel drum and the one of the reel spool and the wound reel transversely to a web run direction.

9 Claims, 5 Drawing Sheets

PROCESS AND WINDING MACHINE FOR WINDING A MATERIAL WEB

CROSS-REFERENCE TO RELATED APPLICATIONS

The present application claims priority under 35 U.S.C. §119 of German Patent Application No. 199 39 506.3, filed on Aug. 20, 1999, the disclosure of which is expressly incorporated by reference herein in its entirety.

BACKGROUND OF THE INVENTION

1. Field of the Invention

The invention relates to a process for winding a material web produced from a pulp suspension and finally dried, e.g., a paper or cardboard web, onto a reel spool to produce a wound reel, in which the material web is smoothed "online" and is then conducted over a reel drum. A winding nip is formed between the reel drum and the reel spool, and the reel drum and the wound reel being formed are held in contact with one another during the winding procedure.

The invention further relates to a winding machine for winding a material web produced from a pulp suspension and finally dried, e.g., a paper or cardboard web, onto a reel spool to produce a wound reel, in which the material web is smoothed "online" and is then conducted over a reel drum. A winding nip is formed between the reel drum and the reel spool, and the reel drum and the wound reel being formed are held in contact with one another during the winding procedure.

2. Discussion of Background Information

Such a process and such a winding machine are known, e.g., from the published European Application No. EP 0 483 092 A1. They are used, e.g., at the end of a machine for producing or finishing a material web. However, they can also be used to rewind an already fully wound reel. The machine in question can be, e.g., a paper or cardboard machine.

From the commonly owned International Publication No. WO 95/30049, of which U.S. Pat. No. 5,685,909 was a U.S. National Stage application, a process and a winding machine are also known for producing paper webs coated bilaterally inside a paper machine in which the coated paper web is smoothed by at least one online calender and is then wound onto a reel spool to produce a wound reel.

Furthermore, in the commonly owned German Utility Model Patent No. DE 297 21 832.8, a device is disclosed for optionally smoothing coated or uncoated material webs, such as, paper or cardboard, that are at least partially dried in the drying section of a paper machine. The disclosed device includes at least one web guide roll, at least one calender, and a reeling device.

Experiments that have been performed have now revealed that, after the online smoothing, irregularities can occur in cross profiles, such as, in particular, in the thickness cross profile of a material web, where the average thickness of the material web is also reduced to about 70 to 30% of its original thickness. These irregularities generally occur only occasionally, in particular in the case of a paper machine, because irregularities can be eliminated, e.g., by adjusting the headbox. Nevertheless, they can have a detrimental effect on the symmetry of the winding construction. Therefore, the result may be that the winding diameter on one side of the material web width is, e.g., larger than the desired diameter. The winding construction is then no longer cylindrical. Moreover, it also results frequently in an undesired overstretching of the material web, which can, e.g., have a considerable effect on the flatness of graphic papers.

SUMMARY OF THE INVENTION

The present invention provides a process as well as a winding machine of the type generally described above, with which, notwithstanding any irregularities in the material web, a substantially always perfect winding construction is ensured in the most simple and reliable manner possible.

In view of the process, the invention provides that the reel spool and/or the reel drum are moved (traversed), preferably axially (or cross-wise), with respect to the web travel direction of the fed material web. In a further embodiment of the invention, the movement can be achieved by a cyclical tilting of the reel spool and/or the reel drum. The concept of traversing movement is a well-known concept to those skilled in the art of printing press construction. The traversing ability designates the possibility of displacing a component axially along its longitudinal axis. For example, printing rollers are accommodated bilaterally on a machine frame in roller bearings so that they can be moved, i.e., can be displaced axially. Such a printing roller is disclosed in, e.g., German Utility Model No. DE 296 11 112. Moreover, the concept of traversing is sufficiently well-known in textile machinery construction. A known traversing is that part of a textile machine, preferably textile machines for the production of synthetic threads, that by a to-and-fro movement of the winding-on thread, ensures that a regular thread winding is formed. Most recently, the concept of traversing has also been used in paper and cardboard machine construction in accordance with the above explanations.

Thus, the reel spool or the reel drum can be alternately displaced or tilted in the one and then in the other direction. However, the reel drum and the wound reel being formed on the reel spool are held in contact with one another during the winding procedure, i.e., the winding nip is maintained. As a result of the movement, any irregularities that occur in the material web, e.g., an irregularly changing thickness cross profile, may be distributed over the web width over quite a large area, so that an impairment of the desired winding construction is virtually excluded and an at least approximately cylindrical winding diameter can be achieved in spite of any irregularities. By the controlled movement of the reel spool or the reel drum, the material web can be deflected in the web travel direction of the material web by the desired amount and is thus moved on the reel spool.

In a preferred practical embodiment of the process according to the invention, the reel spool is moved, preferably axially, and the movable reel drum is tracked to maintain the winding nip. In particular, the line load in the winding nip can also be adjusted via the movable reel drum, and this line load preferably can be held constant at a value that can be specified in advance. The reel spool is advisably moved along at least one guideway, with it optionally being simultaneously tilted in a cyclical manner while being moved.

So that the reel drum can always follow the reel spool even at the optionally simultaneous cyclical tilted position and, so that the line load in the winding nip can also be kept constant, the tilted position of the reel spool should ordinarily be no greater than the lift of the reel drum.

While in the preferred embodiment the reel spool is moved, e.g., axially, and the movable reel drum is tracked to maintain the winding nip, in principle an embodiment of the process according to the invention is also conceivable in which the reel drum is moved, e.g., axially, and the movable reel spool is tracked to maintain the winding nip.

If the material web is conducted over a web guide roll in the web travel direction of the material web before the reel drum, this web guide roll is also preferably moved, e.g., axially. In this connection, the movement of this web guide roll advisably takes place so that at least essentially equal longitudinal tensions result in both edge regions of the fed material web.

It is advisable for the web guide roll to be moved in a vertical plane.

In a preferred embodiment, the reel spool and/or the reel drum may be moved, e.g., axially (cross-wise), with respect to the web travel direction of the fed material web only when certain roughness values of the material web are present. This results in the advantage from the point of view of operational efficiency that, with material webs having very small differences with respect to their roughness values, e.g., material webs of LWC or LC grades of paper, no traversing of the material web takes place. Preferably, the roughness values include the value range of about 0.05 to 1.25 PPT, preferably about 0.5 to 1.15 PPT, with the roughness values furthermore being measured by at least one roughness sensor. PPT (Parker Print Surf) is the unit of roughness determination by the print surf method, which is standardized in DIN ISO 8791 Part 4, the disclosure of which is expressly incorporated by reference herein in its entirety. This standard should be referred to as far as the range of application, measuring principle, measuring instrument, sampling, and the like are concerned.

In a further preferred embodiment of the invention, the reel spool and/or the reel drum are moved, e.g., axially, with respect to the web travel direction of the fed material web only at a web speed of greater than or equal to (≧) about 800 m/min, preferably greater than or equal to about 1000 m/min. As already explained above, experiments that have been performed have revealed that, after online smoothing, particularly at higher web speeds, irregularities can occur in cross profiles, e.g., in the thickness cross profile of a material web, where the average thickness of the material web is reduced to about 70 to 30% of its original thickness. In order to be able to compensate for or completely stop these irregularities during the winding construction in the course of the production process, the moving of the reel spool and/or the reel drum is provided for according to the invention when the above-mentioned speeds are reached.

The winding machine according to the invention includes a reel spool and/or a reel drum can be moved, e.g, axially (cross-wise), with respect to the web travel direction of the fed material web by at least one assigned drive device or pressing device.

Advantageous developments of the winding machine according to the invention are given in the subclaims.

Of course, the above-mentioned features of the invention and those to be explained below can be used not only in the combinations given, but also in other combinations or alone, without departing from the scope of the invention.

The present invention is directed to a process for winding a material web onto a reel spool to produce a wound reel. The process includes producing the material web, online smoothing of the produced material web, guiding the smoothed material web over a reel drum and through a nip formed between the reel drum and one of the reel spool and the wound reel, maintaining contact between the reel drum and the one of the reel spool and the wound reel, and reeling the smoothed material web while transversely moving at least one of the reel drum and the one of the reel spool and the wound reel relative to a web travel direction.

In accordance with a feature of the invention, the producing of the web may include producing the web from a pulp suspension and dried. Further, the material web may include one of a paper and cardboard web. The online smoothing can include guiding the produced material web through an online calender. The moving of the at least one of the reel drum and the one of the reel spool and the wound reel axially can displace the material web along the one of the reel spool and the wound reel.

According to a further feature of the instant invention, the moving of the at least one of the reel drum and the one of the reel spool and the wound reel may include a cyclical tilting of at least one of the one of reel spool and the reel drum the moving of the material web can include a cyclical tilting of at least one of the one of reel spool and the reel drum.

The reel spool can be moved and the movable reel drum can be tracked to maintain the nip. The reel spool may be moved in a substantially axial direction. Further, a line load in the nip can be adjustable via the movable reel drum, and the line load in the nip may be maintained at a substantially constant predetermined value.

Moreover, the reel drum can be moved and the movable reel spool may be tracked to maintain the nip. The reel drum can be moved in a substantially axial direction.

The process can also include guiding the material web over a movable web guide roll in the web travel direction web before the reel drum. Movement of the guide roll moves the material web along the guide roll. The material web may move substantially along an axial direction of the guide roll. Further, the moving of the web guide roll can provide at least essentially equal longitudinal tensions in both the edge regions of fed material web. The web guide roll can be traversed by the material web in a vertical plane.

According to another feature of the invention, the moving of the at least one of the reel drum and the one of the reel spool and the wound reel occurs when certain roughness values of the material web are present. The roughness values are within a range of between about 0.05–1.25 PPT, and preferably within a range of between about 0.5–1.15 PPT. The process can further include measuring the roughness values with at least one roughness sensor.

In accordance with still another feature of the present invention, the process may further include feeding the material web as a speed of ≧ about 800 m/min, and preferably the feed speed is 24 about 1000 m/min.

According to a further feature of the instant invention, the moving of the at least one of the reel drum and the one of the reel spool and the wound reel includes positioning the at least one of the reel drum and the one of the reel spool and the wound reel obliquely to the web travel direction.

In accordance with a still further feature of the invention, the following relationship is fulfilled:

$$Ch = (Dk + Dt)x\frac{Hh}{LE}$$

in which: Ch represents an axial traversing lift; Dk represents a diameter of the reel drum; Dt represents a diameter of the wound reel 20 being formed; Hh represents a maximum tilt position of the reel spool; and LE represents the lengths of the reel spool and the reel drum, which are measured between the points of attachment of one of a drive and a pressing device.

The present invention is directed to an apparatus for winding a material web onto a reel spool to produce a wound reel. The apparatus includes a web production facility, an online smoothing device, a reel drum, and a reel spool. A nip is formed between the reel drum and one of the reel spool and the wound reel, and the reel drum and the one of the reel spool and the wound roll are arranged to maintain contact during a winding procedure. At least one device is arranged to move at least one of the reel drum and the one of the reel spool and the wound reel transversely to a web run direction.

In accordance with a feature of the invention, the web production facility can be structured and arranged to produce the material web from a pulp suspension which has been dried.

According to another feature of the present invention, the material web can include one of a paper and cardboard web.

According to another feature of the invention, the online smoothing device can include an online calender.

In accordance with still another feature of the instant invention, the moving of the at least one of the reel drum and the one of the reel spool and the wound reel can result in an axial movement of the material web relative to the one of the reel spool and the wound reel.

According to another feature of the present invention, the at least one device can include a drive device and a pressing device.

In accordance with a further feature of the instant invention, the at least one device can be arranged to cyclically tilt at least one of the reel drum and the one of the reel spool and the wound reel.

The at least one device can include a drive device coupled to move the reel spool. In this manner, the material web can axially move along the one of the reel spool and the wound reel. The at least one device can further include a pressing device coupled to the reel drum to maintain the nip. A line load in the nip may be adjustable via the pressing device coupled to the reel drum. The line load in the nip can be maintained at a predetermined value.

According to still another feature of the instant invention, the at least one device may include a drive device coupled to move the reel drum, such that the material web can be axially moved along the one of the reel spool and the wound reel. Further, the at least one device can include a pressing device coupled to the one of the reel spool and the wound reel to maintain the nip.

A web guide roll can be arranged before, relative to the web travel direction, the reel drum. The material web may be guided over the web guide roll before being guided over the reel drum. The web guide roll can be coupled to the at least one device. The at least one guide device can include a driving device. Further, the at least one device may include a driving device coupled to move the web guide roll transversely to the web travel direction. At least essentially equal longitudinal tensions result in both edge regions of the material web. The material web may be guided to traverse the web guide roll in a substantially vertical plane.

In accordance with a further feature of the present invention, at least one of the reel drum and the one of the reel spool and the wound reel is movable relative to the web travel direction via the at least one device. At least one of the reel drum and one of the reel spool and the wound reel is movable when certain roughness values of the material web are present. The roughness values can include a value range between about 0.05 and 1.25 PPT, and preferably a value range between about 0.5 and 1.15 PPT. Further, at least one roughness sensor may be arranged to measure roughness values of the material web.

In accordance with yet another feature of the instant invention, the material web can be fed at a speed of ≧ about 800 m/min, and preferably fed at a speed of ≧ about 1000 m/min.

The present invention is directed to a process for winding a material web onto a reel spool to produce a wound reel. The process includes producing the material web, online smoothing of the produced material web, guiding the smoothed material web over a reel drum and through a nip formed between the reel drum and one of the reel spool and the wound reel, maintaining contact between the reel drum and the one of the reel spool and the wound reel, and reeling the smoothed material web while moving at least one of the reel drum and the one of the reel spool and the wound reel relative to a web travel direction.

According to another feature of the invention, the at least one of the reel drum and the one of the reel spool and the wound reel can be moved crosswise to tie web travel direction. Further, the at least one of the reel drum and the one of the reel spool and the wound reel can be cyclically moved to a position obliquely to the web travel direction.

In accordance with yet another feature of the present invention, the at least one of the reel drum and the one of the reel spool and the wound reel can be cyclically moved to a position obliquely to the web travel direction.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
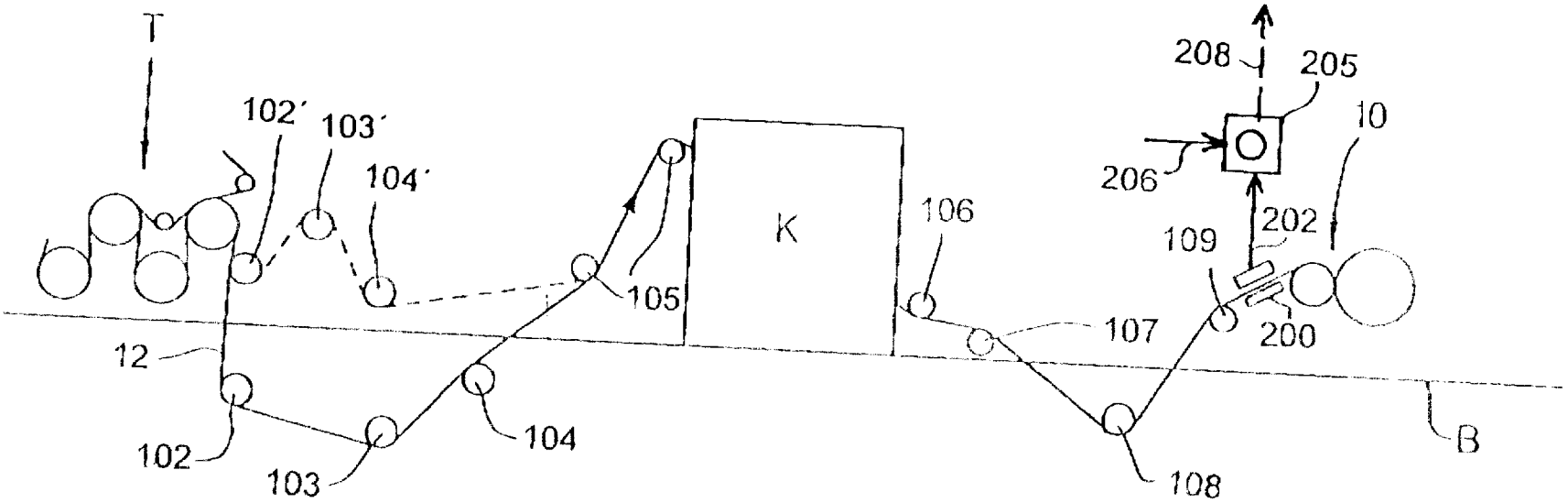
FIG. 1 schematically illustrates a side view of a device for producing paper or cardboard, having a winding machine provided subsequent to an online calender.

FIG. 1 shows a schematic side view of a device for producing paper or cardboard, having a winding machine 10 according to the invention provided subsequent to an online calender K.

As can be seen from this FIG. 1, after material web 12 has left a drying section T, it runs over web guide rolls 102 to 105 or 102' to 104' into an online calender K, which can be, for example, a supercalender or one or more other calenders that are known per se, and from there over web guide rolls 106 to 109 to a winding machine 10, which can be designed as described further below.

A process according to the invention is thus in particular also conceivable in which material web 12, produced from a pulp suspension and finally dried, is wound subsequent to an online smoothing of material web 12 following the drying, and correspondingly an axial traversing of material web 12 is produced in wound reel 20 subsequent to this online smoothing. The web guide characterizing the online operation is shown in FIG. 1 by a continuous line.

In the present exemplary embodiment, web guide rolls 102 to 104 are arranged below floor B of the paper machine, i.e., in the basement, while web guide rolls 102', 103', 104', and 105 are situated above the floor of the paper machine. This alternative web guide up to web guide roll 105 is shown in FIG. 1 by a dotted line.

In the present case the web guide rolls 106, 107, and 109 are provided above floor B of the paper machine, while web guide roll 108 is installed in the basement.

In each case, the space available is decisive in selecting the arrangement of the web guide rolls.

In principle it is also possible to further treat, e.g., to coat, material web 12 smoothed in online calender K after it has been wound in winding machine 10 according to the invention, in accordance with the desired quality.

FIG. 1 also shows at least one roughness sensor 200, with which the roughness values of material web 12 are measured, roughness sensor 200 is preferably mounted after online calender K and as close as possible before winding machine 10. It can be designed both as a stationary roughness sensor 200 and as a roughness sensor 200 moving (traversing) the width of the material web. The sensor signal is relayed via a line 202 to roughness regulator 205, which compares the theoretical roughness value range obtained via line 206 (theoretical values) with the sensor signal (actual values) using automatic control technology, and if there is an inadmissible deviation, relays a setting via line 208 to the controls of winding machine 10. In principle, it is also possible to operate the roughness regulator manually, i.e., to deliver a setting permanently (constant axial traversing) and to stop it permanently (no axial traversing).

A winding machine, along with its assigned drive controls for carrying out the process according to the invention, is known, for example, from the commonly owned German Patent Application No. DE 198 22 261 A1, the disclosure of which is expressly incorporated by reference herein in its entirety.

Figure 2:
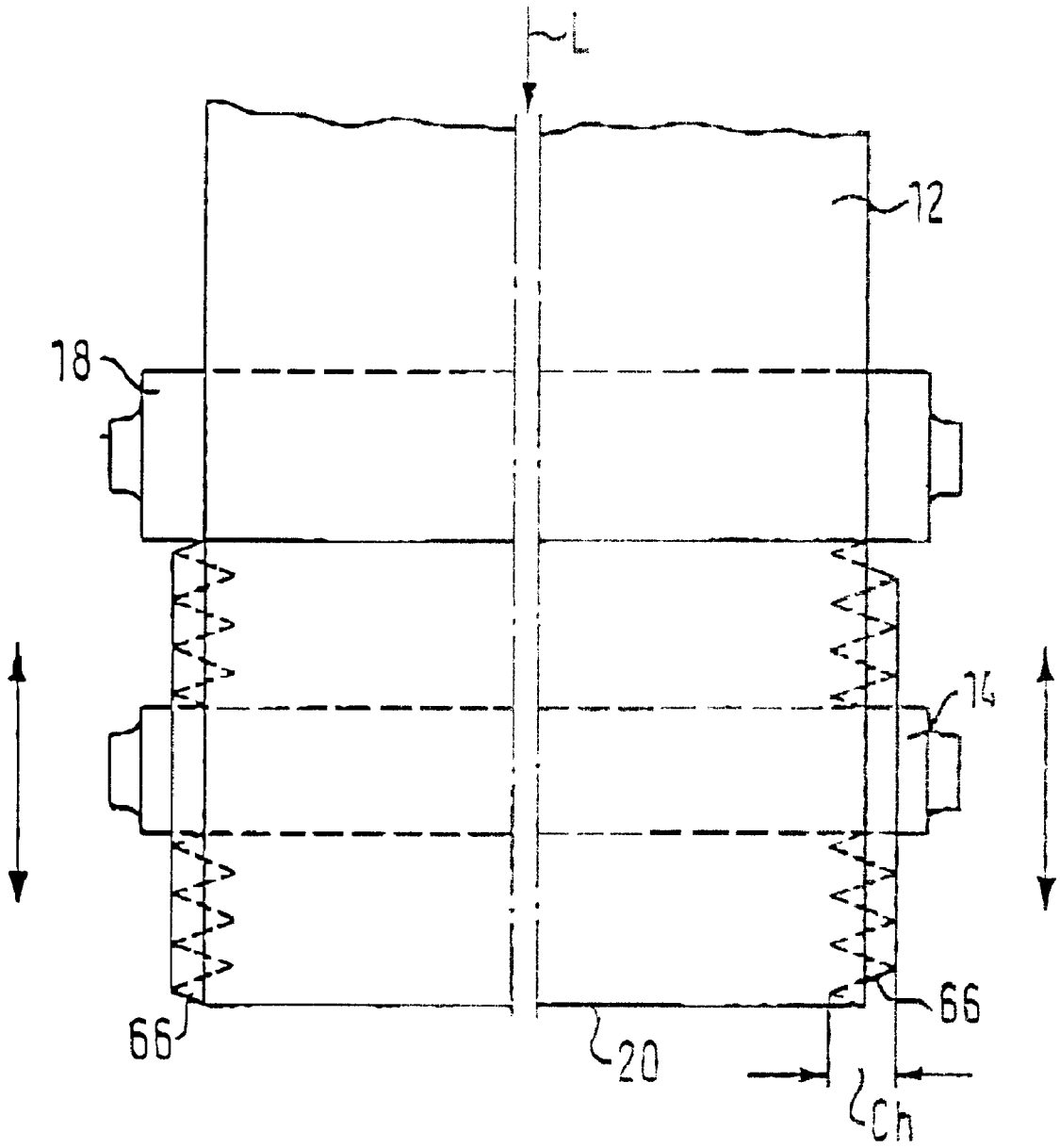
FIG. 2 schematically illustrates a top view of the winding machine according to FIG. 1.

FIG. 2 shows a schematic top view of the winding machine according to FIG. 1, where the movement (traversing) of reel spool 14 with notched edges 66 and the stationary seating of reel drum 18 is clearly visible. The movement can be performed, for example, so that the following relation is fulfilled:

$$Ch = (Dk + Dt)x\frac{Hh}{LE}$$

where

Figure 3:
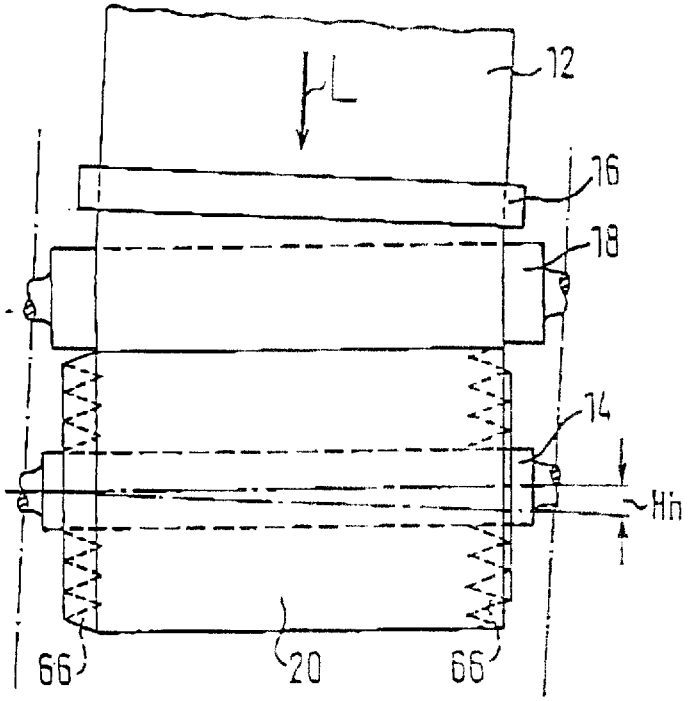
FIG. 3 schematically illustrates a further top view of the winding machine according to FIG. 1.
Figure 5:
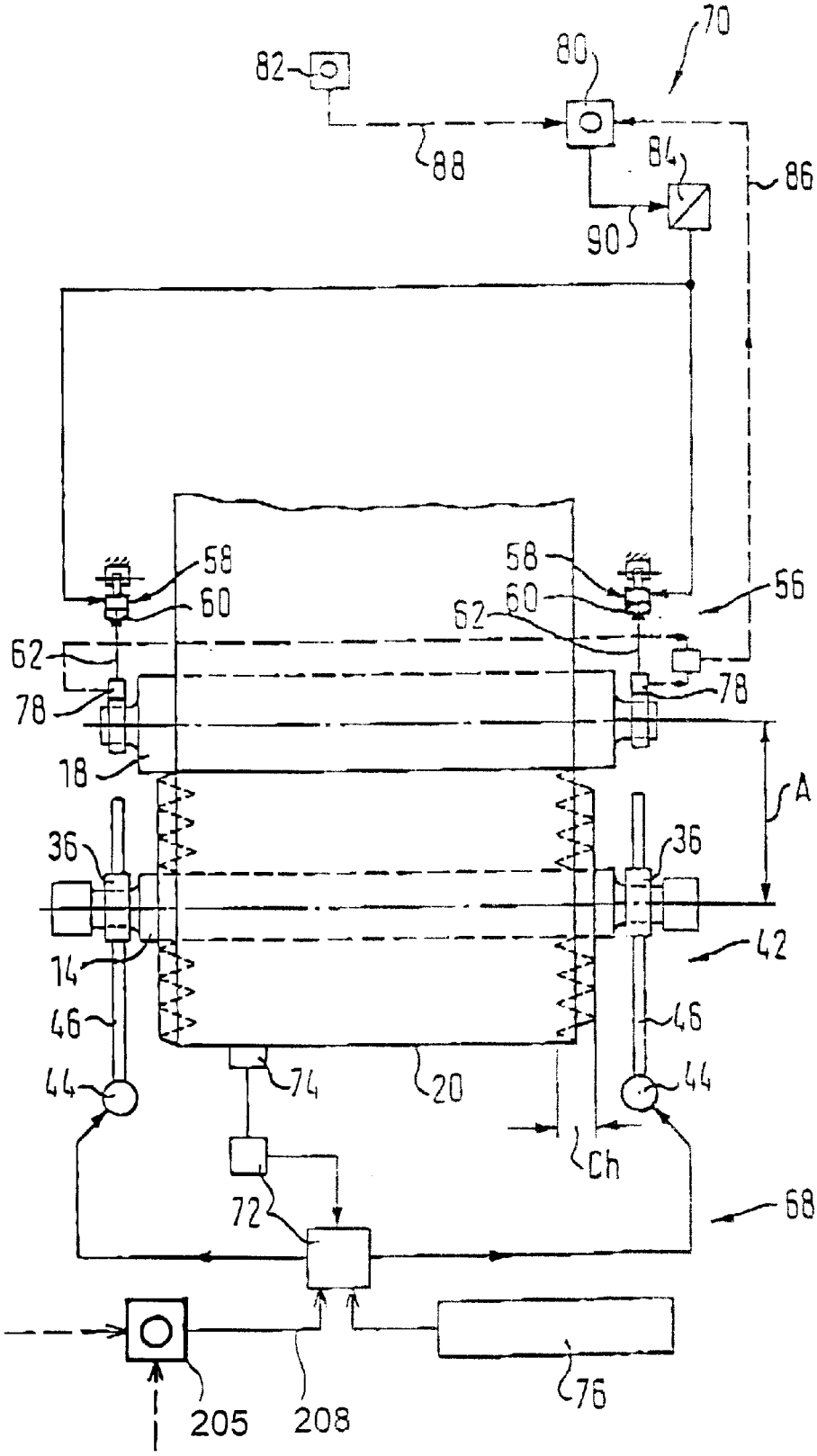
FIG. 5 illustrates a partial view of the winding machine corresponding to FIG. 2 with the drive devices assigned to the reel drum and the reel spool, and the controls assigned thereto.

Ch=axial traversing lift;

Dk=diameter of reel drum 18;

Dt=diameter of wound reel 20 being formed;

Hh=maximum tilt position of reel spool 14 or wound reel 20 being formed (cf. FIG. 3);

LE=the lengths of reel spool 14 and reel drum 18, measured between the points of attachment of drive device 42 or pressing device 56 (cf. in particular FIGS. 2 and 5).

While reel spool 14 and reel drum 18 extend according to FIG. 2 cross-wise to web travel direction L of the web, in FIG. 3 they occupy a tilted position. Web guide roll 16 extending cross-wise to web travel direction L of the web can also be seen in FIG. 3.

Figure 4:
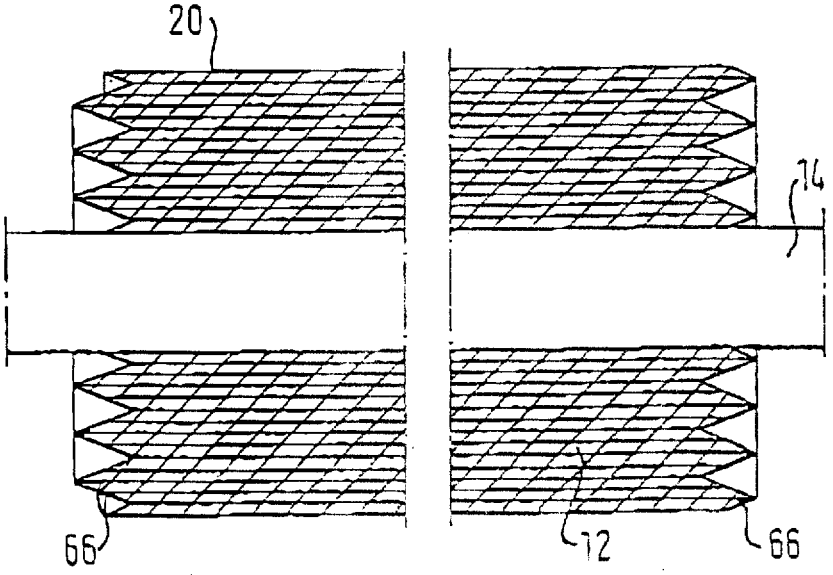
FIG. 4 illustrates a sectional view of the finished wound reel, cut along the vertical line through the core of the reel spool.

A sectional view of finished wound reel 20, cut along the vertical line through the core of reel spool 14, is shown in FIG. 4. It is clearly visible that, owing to the axial movement of reel spool 14 and/or the reel drum (not shown), i.e., cross-wise to web travel direction L, material web 12 has been wound onto reel spool 14 with notched edges 66.

In FIG. 5, controls 68 and 70 assigned to drive devices 42 and pressing device 56 are shown purely schematically, with pressing device 56 including at least two cylinder/piston units 58 that grip both ends of reel drum 18, each of whose pistons 60 is connected to a piston rod 62 acting upon the applicable end of the reel drum.

Controls 68 assigned to reel spool 14 include a control unit 72 that controls two electric motors 44 driving threaded spindles 46 as a function of the growth in the diameter of wound reel 20. The growth in the diameter of wound reel 20 is then measured by at least one measuring device 74. The increase in the winding diameter is compensated for accordingly via drive device 42 assigned to reel spool 14. In addition, controls 68 work according to a traversing program 76 entered into control unit 72, which program ensures that two electric motors 44 are controlled such that reel spool 14 and/or wound reel 20 is tilted cyclically in the desired manner and the desired axial movement of material web 12 is produced in wound roll 20 being formed. Control unit 72 is also acted upon according to the invention by roughness regulator 205 via line 208, which regulator has already been shown and its function described in FIG. 1.

Controls 70 assigned to reel drum 18 effect the desired line load regulation, by which reel drum 18 simultaneously tracks wound reel 20 so that it is also tilted cyclically in accordance. This control or regulating device 70 includes measuring devices 78 for the line load, a regulator 80, a setting 82, and a control unit 84, measuring devices 78 are connected to regulator 80 via a measuring line 86, in order to deliver a corresponding actual value to the regulator. Setting 82 delivers the respective theoretical value to regulator 80 via a line 88. Regulator 80 is again connected to control unit 84 via line 90, via which finally trio cylinder/piston units 58 are acted upon accordingly.

Figure 6:
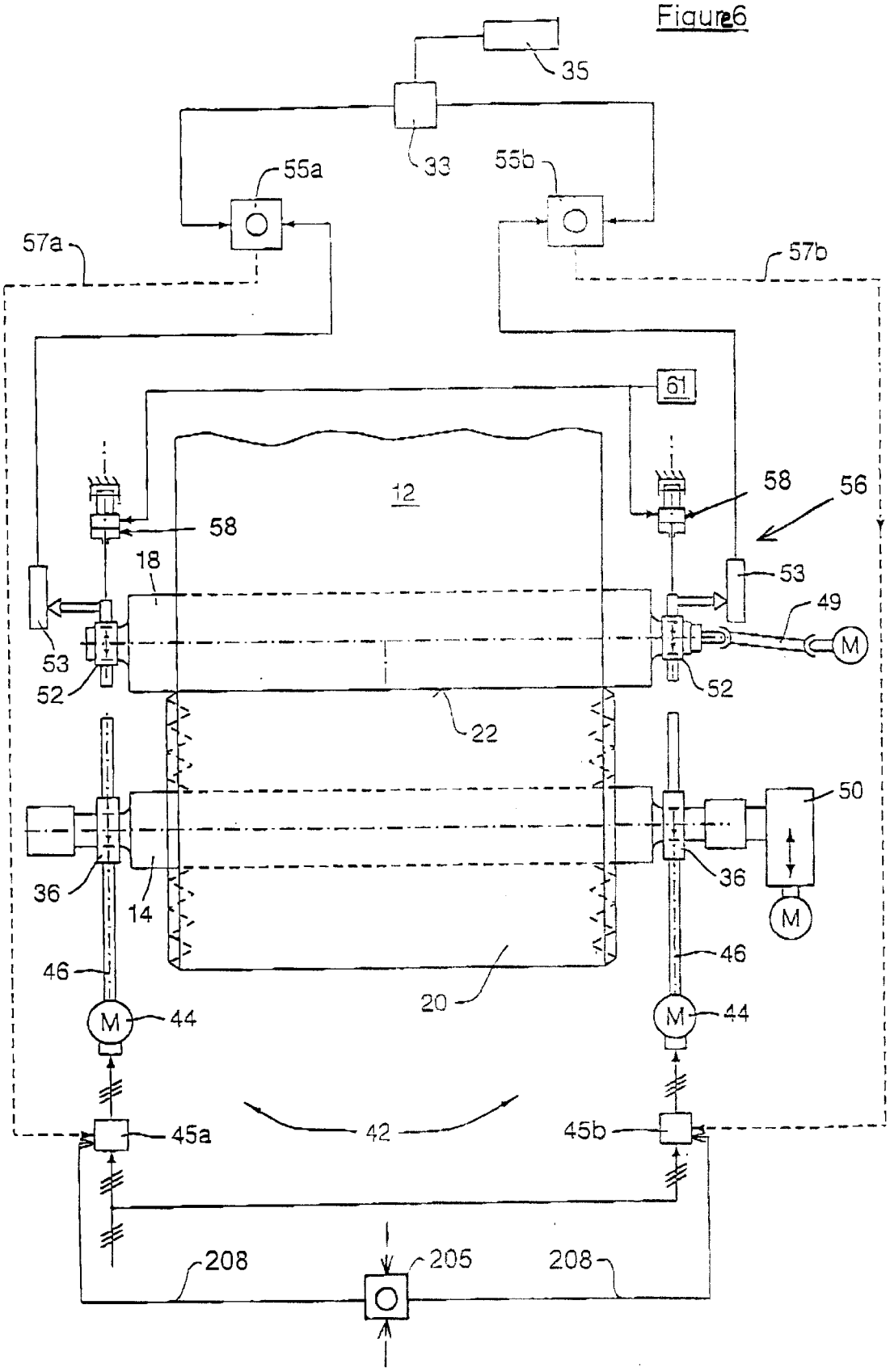
FIG. 6 illustrates a partial views of the winding machine corresponding to FIG. 2 with a further possible embodiment of the controls assigned to the drive devices of the reel drum and the reel spool.

FIG. 6 shows a partial view of the winding machine corresponding to FIG. 5 with a further possible embodiment of the controls assigned to the drive devices of the reel drum and the reel spool. In the present case, this is again a winding machine for winding a material web 12, such as, a paper or cardboard web, on a reel spool 14, in which material web 12 is conducted over a reel drum 18 and a winding nip 22 is formed between reel drum 18 and reel spool 14. Reel drum 18 and wound reel 20 being formed can again be held in contact with one another during the winding procedure, in order to maintain winding nip 22. Reel spool 14 can be tilted cyclically with respect to web travel direction L of fed material web 12 by a drive device 42 including two drives 44 and 46, in order to produce an axial traversing of material web 12 in wound reel 20 being formed, reel drum 18 can be moved by at least one assigned pressing device, and can track to maintain winding nip 22. The line load in winding nip 22 can be adjusted via at least one pressing device assigned to movable reel drum 18. The increase in the winding diameter can again be compensated for at least partially by a corresponding displacement of reel spool 14 or wound reel 20 being formed, via drive device 42 assigned to reel spool 14.

Reel spool 14 is pivoted in two transport devices 36. Each of these two transport devices 36 is provided with a drive 44 and 46 assigned to drive device 42 and with a control device 45*a* and 45*b* assigned to the drive. Each control device is also acted upon according to the invention by roughness regulator 205 via line 208, which regulator has already been shown and its function described in FIG. 1.

Reel drum 18 is pivoted in two movable guide blocks 52. A position-measuring device 53 is assigned to each of two guide blocks 52, which device produces an actual position value preferably dependent upon the instantaneous position of reel drum 18, which position value can be supplied to a position regulator 55*a*, 55*b*.

By position regulator 55*a* and 55*b*, the actual position value is compared in each case with the applicable theoretical position value. Each position regulator 55*a* and 55*b* of applicable control device 45*a* and 45*b* delivers an actuating variable corresponding to the deviation of the actual value from the theoretical value.

Two position regulators 55*a* and 55*b* can be mounted on a common setting 33. In this connection, setting 33 can feed a constant theoretical value to position regulator 55*a* and a cyclically changing theoretical value to other position regulator 55*b*, for example.

An embodiment is also conceivable, for example, in which setting 33 feed opposite cyclically changing theoretical values to two position regulators 55*a* and 55*b*.

As can be seen from FIG. 6, setting 33 can be controlled by a traversing programmer 35 in order to feed appropriate cyclically variable theoretical values to position regulators 55*a* and 55*b*. Position regulators 45*a* and 45*b* assigned to the two different sides are connected respectively via a line 57*a* or 57*b* to applicable control device 45*a* or 45*b*. The line load in winding nip 22 can be adjusted by the pressing device assigned to reel drum 18. This device can be part of a regulator circuit that adjusts the line load automatically to a desired value or holds it at the desired value. The pressure in cylinder/piston units 58 can also be adjusted by a control unit 61 depending on the longitudinal tension of arriving material web 12 and/or the increasing diameter of the wound reel and/or other parameters.

Reel spool 14 can be acted upon by a secondary drive 50 which, in the present exemplary embodiment, is designed as a central drive and can be displaced along the second guideway, not shown.

Reel drum 18 can be driven, for example, by a drive shaft 49.

In the present exemplary embodiment, reel spool 14 is thus acted upon by assigned drive device 42 such that wound reel 20 being formed is tilted cyclically with respect to web travel direction L of fed material web 12, in order to produce an axial traversing of material web 12 in would reel 20 being formed This is shown in FIG. 6 by the zigzag edges of wound reel 20. Movable reel drum 18 is tracked correspondingly by assigned pressing device 56 including cylinder/piston units 58, as a result of which winding nip 22 is maintained and the line load in this winding nip 22 is held constant, e.g., at a previously specified value.

The line load in winding nip 22 is adjusted by pressing device 56 assigned to reel drum 18. As can be seen in particular from FIG. 5, pressing device 56 is part of a regulator circuit that automatically adjusts the line load to a desired value or holds it at the desired value. Variations in the line load can be securely compensated for or avoided by displacing reel drum 18 by pressing device 56, so that the respectively desired winding tightness can be achieved continuously. The increasing diameter of wound reel 20 is compensated for by a corresponding displacement of this wound reel 20 in the direction of arrow 64.

In summary, it should be noted that, in accordance with the features of the instant invention, a process and a winding machine of the type generally discussed above are created, with which, notwithstanding any irregularities in the material web, a substantially perfect winding construction can be ensured in the most simple and reliable manner possible.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

| | |
|---|---|
| 10 | Winding machine |
| 12 | Material web |
| 14 | Reel spool |
| 16 | Web guide roll |
| 18 | Reel drum |
| 20 | Wound reel |
| 22 | Winding nip |
| 33 | Setting |
| 35 | Traversing programmer |
| 36 | Transport device |
| 42 | Drive device |
| 44 | Electric motor |
| 44, 46 | Drive |
| 45a | Control device |
| 45b | Control device |
| 46 | Threaded spindle |
| 49 | Drive shaft |
| 50 | Secondary drive |
| 52 | Guide block |
| 53 | Position measuring device |
| 55a | Position regulator |
| 55b | Pressing regulator |
| 56 | Pressing device |
| 57a | Line |
| 57b | Line |

-continued

| LIST OF REFERENCE CHARACTERS | |
|---|---|
| 58 | Cylinder/piston unit |
| 60 | Piston |
| 61 | Control unit |
| 62 | Piston rod |
| 64 | Arrow |
| 66 | Notched edges |
| 68 | Controls |
| 70 | Controls |
| 72 | Control unit |
| 74 | Measuring device |
| 76 | Traversing program |
| 78 | Measuring devices |
| 80 | Regulator |
| 82 | Setting |
| 84 | Control unit |
| 86 | Measuring line |
| 88 | Line |
| 90 | Line |
| 92 | Drive device |
| 102, 102' | Web guide roll |
| 103, 103' | Web guide roll |
| 104, 104' | Web guide roll |
| 105 | Web guide roll |
| 106 | Web guide roll |
| 107 | Web guide roll |
| 108 | Web guide roll |
| 109 | Web guide roll |
| 200 | Roughness sensor |
| 202 | Line |
| 205 | Roughness regulator |
| 206 | Line |
| 208 | Line |
| B | Paper machine floor |
| K | Online calender |
| L | Web travel direction |
| T | Drying section |

What is claimed:

1. A process for winding a material web onto a reel spool to produce a wound reel, the process comprising:

producing the material web;

online smoothing of the produced material web;

guiding the smoothed material web over a reel drum and through a nip formed between the reel drum and one of the reel spool and the wound reel;

reeling the smoothed material web while transversely moving at least one of the reel drum and the one of the reel spool and the wound reel relative to a web travel direction; and maintaining contact between the reel drum and the one of the reel spool and the wound reel while reeling the smoothed material web, wherein the moving of the at least one of the reel drum and the one of the reel spool and the wound reel occurs when certain roughness values of the material web are present.

2. The process in accordance with claim 1, wherein the roughness values are within a range of between about 0.05–1.25 PPT.

3. The process in accordance with claim 2, wherein the roughness values are within a range of between about 0.5–1.15 PPT.

4. The process in accordance with claim 1, further comprising measuring the roughness values with at least one roughness sensor.

5. A process for winding a material web onto a reel spool to produce a wound reel, the process comprising:

producing the material web;

online smoothing of the produced material web;

guiding the smoothed material web over a reel drum and through a nip formed between the reel drum and one of the reel spool and the wound reel;

reeling the smoothed material web while transversely moving at least one of the reel drum and the one of the reel spool and the wound reel relative to a web travel direction; and maintaining contact between the reel drum and the one of the reel spool and the wound reel while reeling the smoothed material web, wherein the following relationship is fulfilled:

$$Ch = (Dk + Dt)x\frac{Hh}{LE}$$

in which:

Ch represents an axial traversing lift;

Dk represents a diameter of the reel drum;

Dt represents a diameter of the wound reel being formed;

Hh represents a maximum tilt position of the reel spool; and

LE represents the lengths of the reel spool and the reel drum, which are measured between the points of attachment of one of a drive and a pressing device.

6. A apparatus for winding a material web onto a reel spool to produce a wound reel, comprising:

a web production facility;

an online smoothing device;

a reel drum;

a reel spool, wherein a nip is formed between said reel drum and one of said reel spool and said wound reel, and wherein said reel drum and said one of said reel spool and said wound roll are arranged to maintain contact during a winding procedure; and at least one device arranged to move at least one of said reel drum and said one of said reel spool and said wound reel transversely to a web run direction, wherein at least one of said reel drum and said one of said reel spool and said wound reel is movable relative to the web travel direction via said at least one device, and wherein said at least one of said reel drum and one of said reel spool and said wound reel is movable when certain roughness values of the material web are present.

7. The apparatus in accordance with claim 6, wherein the roughness values include a value range between about 0.05 and 1.25 PPT.

8. The apparatus in accordance with claim 6, wherein the roughness values include a value range between about 0.5 and 1.15 PPT.

9. The apparatus in accordance with claim 6, further comprising at least one roughness sensor arranged to measure roughness values of the material web.

* * * * *